US007029370B2

(12) United States Patent
Cochran et al.

(10) Patent No.: US 7,029,370 B2
(45) Date of Patent: Apr. 18, 2006

(54) GRINDING MACHINES FOR DEPRESSION PATTERNS ALONG ROADS

(75) Inventors: Gary L. Cochran, Colwich, KS (US); Dennis Skraba, Irmo, SC (US)

(73) Assignee: Coneqtec Corp., Wichita, KS (US)

( * ) Notice: Subject to any disclaimer, the term of this patent is extended or adjusted under 35 U.S.C. 154(b) by 0 days.

(21) Appl. No.: 10/784,609

(22) Filed: Feb. 23, 2004

(65) Prior Publication Data

US 2004/0166774 A1 Aug. 26, 2004

Related U.S. Application Data

(60) Provisional application No. 60/449,706, filed on Feb. 24, 2003.

(51) Int. Cl.
*E01C 23/09* (2006.01)
*B24B 49/00* (2006.01)

(52) U.S. Cl. ..... 451/11; 451/352; 299/39.6; 404/94

(58) Field of Classification Search ..... 451/11, 451/23–25, 352, 358; 299/39.4, 39.6; 404/94, 404/72, 90, 93
See application file for complete search history.

(56) References Cited

U.S. PATENT DOCUMENTS 3,094,047 A 6/1963 Patton
3,663,061 A 5/1972 Miller
3,697,135 A 10/1972 Hatcher et al.
3,724,900 A 4/1973 Hatcher et al.
3,807,634 A 4/1974 Vogt
3,989,304 A 11/1976 Wirtgen
4,463,989 A * 8/1984 Kennedy ..... 299/39.4
4,701,069 A 10/1987 Whitney
4,744,604 A 5/1988 Lewis et al.
4,793,732 A 12/1988 Jordan
4,797,025 A 1/1989 Kennedy
4,824,516 A 4/1989 Ishihara et al.
4,896,995 A 1/1990 Simmons
4,900,094 A 2/1990 Sergeant
4,938,537 A 7/1990 Rife, Jr. et al.
4,943,199 A 7/1990 Hillen
4,986,604 A 1/1991 Meister
5,046,890 A 9/1991 Dickson
5,059,061 A 10/1991 Stenemann et al.
5,094,565 A 3/1992 Johnson
5,161,910 A 11/1992 O'Konek
5,215,071 A * 6/1993 Mertes et al. ..... 299/39.1
5,259,692 A 11/1993 Beller et al.

(Continued)

*Primary Examiner*—Hadi Shakeri
(74) *Attorney, Agent, or Firm*—Woodard, Emhardt, Moriarty, McNett & Henry LLP

(57) ABSTRACT

In certain preferred embodiments, the present invention provides a grinding machine for creating depression patterns in a surface such as asphalt or concrete. The depression pattern may be a rumble strip for alerting drivers who drift off a driving lane, or may be for other uses. Use of a depression pattern (instead of protrusions) eliminates interference with snowplow operation in areas where plows are used. In the present invention, the grinding machine is based on a trolley which moves at a uniform height along a surface, and includes a forward "gauge" wheel which controls the relative grinding drum depth based on the wheel position and rotation. In a preferred embodiment, the grinding assembly is raised and lowered relative to the trolley in correspondence with the advancement of the trolley.

25 Claims, 10 Drawing Sheets

U.S. PATENT DOCUMENTS 5,297,894 A 3/1994 Yenick
5,391,017 A 2/1995 Thomas et al.
5,415,495 A 5/1995 Johnson
5,484,228 A 1/1996 Thomas
5,607,255 A * 3/1997 Thomas et al. ..... 404/90
5,676,490 A 10/1997 Nelson
5,957,620 A * 9/1999 Thomas et al. ..... 404/72
6,176,551 B1 1/2001 Page
6,210,071 B1 4/2001 McSharry
6,227,620 B1 5/2001 Page
6,402,252 B1 * 6/2002 Dickson ..... 299/39.6
6,499,809 B1 * 12/2002 O'Konek ..... 299/39.6
6,843,535 B1 * 1/2005 Thomas et al. ..... 299/39.4
2002/0110420 A1 8/2002 Murphy
2003/0035687 A1 2/2003 Gray

* cited by examiner

GRINDING MACHINES FOR DEPRESSION PATTERNS ALONG ROADS

This application claims the benefit of provisional application Ser. No. 60/449,706 filed on Feb. 24, 2003.

FIELD OF THE INVENTION

This invention relates generally to grinding machines, and more particularly to a system and method for grinding depression patterns in asphalt or concrete adjacent to road driving lanes.

BACKGROUND OF THE INVENTION

One safety feature introduced in many new road and highway constructions is the inclusion of sonic noise (or nap) alert patterns (SNAPs) created as rumble strips alongside driving lanes. These depression patterns interfere with the smooth driving of a vehicle by creating a noise and a vibration when a vehicle encounters the pattern. This interference serves as a warning to drivers that they are leaving the desired driving lane, for example due to a lapse in attention or drift. Once warned, the driver can preferably correct the vehicle's course, if leaving was unintentional or inadvertent.

There have been various methods for imparting the depression patterns to the roadway asphalt or concrete. One method has been to apply a roller with protrusions matching the desired pattern while the asphalt is still hot and/or the concrete is still wet. This method does not work after the material has set. An alternate method involves plunge grinding depressions by mechanically raising and lowering a grinding drum in each position where a depression is desired. This can be a lengthy process and requires precise re-positioning for each new cut. A still further method, as discussed in U.S. Pat. No. 5,391,017, utilizes an offset axle on a front bearing wheel or an elliptical wheel to raise and lower the entire grinding machine as the wheel rotates. On less than ideal surfaces, the bearing wheel can slip, causing poor depression spacing.

Consequently, there is a need for an improved grinding machine to create depression patterns along roads.

SUMMARY OF THE INVENTION

In certain preferred embodiments, the present invention provides a grinding machine for creating depression patterns in a surface such as asphalt or concrete. The depression pattern may be a rumble strip for alerting drivers who drift off a driving lane, or may be for other uses. Use of a depression pattern (instead of protrusions) eliminates interference with snowplow operation in areas where plows are used.

In one embodiment of the present invention, the grinding machine is based on a grinding drum associated with a surface following portion, such as a frame or trolley, which typically moves at a uniform height along or above a surface for stable support. A "gauge" or "displacement" wheel controls the relative grinding drum depth based on the wheel position and angular rotation. Preferably, hydraulic power is supplied to the cutting drum and a height adjustment mechanism. The machine may be mounted on a host machine, such as a skid/steer loader, or it may operate independently.

In one preferred embodiment, the present invention involves a grinding machine comprising a trolley to be moved along a surface to be ground and having a hydraulic grinding assembly mounted to the trolley. A mechanism, such as a hydraulic control device, causes the grinding assembly to be raised and lowered relative to the trolley in a predetermined pattern, for example in correspondence with the advancement of the trolley.

In a further preferred embodiment, the present invention involves a grinding machine with a surface following frame to be moved at a uniform height along a surface to be ground and having a hydraulic grinding assembly mounted to the frame. A gauge wheel contacts the surface to be ground, and is linked, to a mechanism to hydraulically raise and lower the grinding assembly relative to the frame to grind depressions in the surface in correspondence with the advancement of the gauge wheel.

A method according to the present invention involves grinding a series of depressions in a surface. A preferred method provides a hydraulic grinding assembly mounted on a frame. A gauge wheel contacts and advances along the surface while the assembly raises and lowers the grinding assembly relative to the trolley in correspondence with the advancement distance or angular rotation of the gauge wheel. Preferably the raising and lowering is hydraulically controlled.

It is an object of certain preferred embodiments of the present invention to provide an improved grinding machine. Other objects and advantages shall become clear from the enclosed drawings and descriptions.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

In certain preferred embodiments, the present invention provides a grinding machine for creating depression patterns in a surface such as asphalt or concrete. The depression pattern may be a rumble strip for alerting drivers who drift off a driving lane, or may be for other uses. Use of a depression pattern (instead of protrusions) eliminates interference with snowplow operation in areas where plows are used. In the present invention, the grinding machine is based on grinding drum in combination with a surface following portion, such as a trolley or frame which typically moves at a uniform height along or above a surface for stable support. A "gauge" or "displacement" wheel controls the relative grinding drum depth based on the wheel position and rotation. Each angular position of the wheel controls a corresponding vertical position of the cutting drum. Preferably, hydraulic power is supplied to the cutting drum and a hydraulic control height adjustment mechanism. The frame may be mounted on a host machine, such as a skid/steer loader, or it may operate independently as a self-supporting trolley.

Figure 1A:
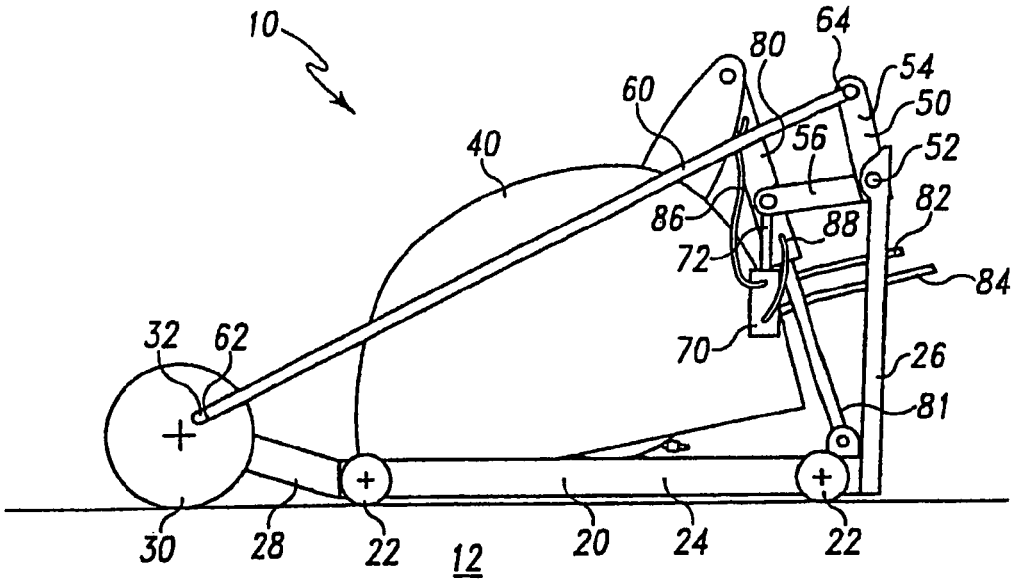
FIG. 1A is an illustration of one preferred embodiment of the present invention.
Figure 1B:
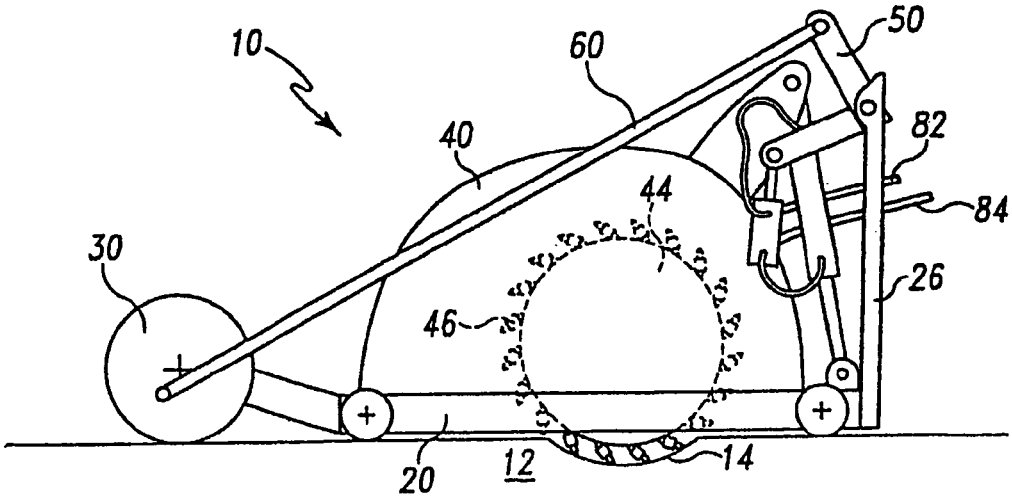
FIG. 1B is an illustration of the embodiment of FIG. 1 in a lowered position.

Illustrated in FIGS. 1A and 1B are the relevant details of one preferred embodiment of the present invention. Cutting machine 10 is shown on a support surface 12 such as a road. In this embodiment, cutting machine 10 includes a surface following frame or trolley 20 supported by ground support elements, typically four wheels or casters 22. Alternately, the trolley can be supported by skids, rollers or a host machine. In one embodiment a host machine is a dedicated machine with a frame which supports the grinding assembly while the machine wheels follow the surface.

Trolley 20 (as pictured) generally includes a frame with two side base members 24, cross-bars (not shown) and an upward brace 26 mounted toward the rear of trolley 20. Trolley 20 may have separate front and rear cross-bars, or the width of cover 40 may serve as a forward cross bar.

Extending forward from trolley 20 is a forward brace 28, upon which is mounted gauge or displacement wheel 30. Gauge wheel 30 is arranged to contact the support surface 12 with sufficient traction to rotate as machine 10 advances. Brace 28 preferably extends forward for the gauge wheel to contact the surface before grinding, but alternately the gauge wheel can be mounted elsewhere, for example, to the rear, middle or sides of the trolley or as a wheel of the trolley or a host machine. Preferably gauge wheel 30 rotates in fixed correspondence to the travel distance of machine 10.

A link, for example rod 60, extends between gauge wheel 30 to a bell crank or corner bracket 50 mounted at pivot point 52 adjacent the upper end of upward brace 26. Rod 60 is pivotally connected adjacent its forward end 62 to a mounting point 32 on gauge wheel 30, where mounting point 32 is preferably offset or eccentric from the wheel axle. Mounting point 32 orbits the wheel axle as the wheel turns. The opposing end portion 64 of rod 60 is pivotally mounted to a point on the upper arm 54 of corner bracket 50. Alternate link arrangements, such as a push-pull cable or an electrically controlled hydraulic system, can also be used.

Various conventional grinding drums may be used. For example, a hydraulically driven grinding drum 44, preferably with cutting tools or teeth 46 is mounted inside cover or shield 40. Preferably in the embodiments of FIGS. 1A and 1B the drum and cover assembly is pivotally mounted to the forward portion of trolley 20. Alternately, arms, slides or other hydraulic movement mechanisms can be used. As shown, hydraulic cylinder 80 extends from the rear of the drum and cover assembly, via piston rod 81, to the rearward portion of trolley 20. Hydraulic adjustment control valve or cylinder 70 is mounted on and preferably towards the rear of cover 40. Valve rod 72 extends from valve 70 to the lower arm 56 of corner bracket 50. Hydraulic fluid supply and return lines 82 and 84 to and from a host unit (not shown), such as a skid/steer loader, are connected to valve 70, with supply and return lines 86 and 88 extending from valve 70 to hydraulic cylinder 80. Grinding drum 44 is hydraulically driven by separate or shared hydraulic lines (not shown).

In one alternate embodiment, an electric control system includes one or more switches activated by rotation of the gauge wheel 30, which is electrically linked to the hydraulic control valve 70. Various types of switches can be used, for example a double throw switch, two single throw switches or proximity switches. Activation of the switch link can cause the cutting assembly to lower and to then rise automatically or to rise only upon further rotation of the guide wheel a specified distance.

In operation, shown in FIGS. 1A and 1B, grinding machine 10 raises and lowers grinding drum 44 and cover 40 in a predetermined pattern as machine 10 is moved forward. As leading gauge wheel 30 rotates, the forward end 62 of rod 60 is pulled and pushed in correspondence to the orbit of offset mounting point 32 around the gauge wheel's axis. Pulling and pushing, also known as advancing and retracting, of rod 60 causes corner bracket 50 to rotate a corresponding amount, which in turn causes valve rod 72 to be pushed or pulled. Pushing or pulling valve rod 72 triggers valve 70 to supply hydraulic fluid, which activates hydraulic cylinder 80 and rod 81 to raise or lower the grinding drum 44 and cover 40 relative to trolley 20. Preferably at least the rear trolley wheels 22 are spaced wider than the width of drum 44, so that the rear wheels do not encounter depressions 14.

Figure 2A:
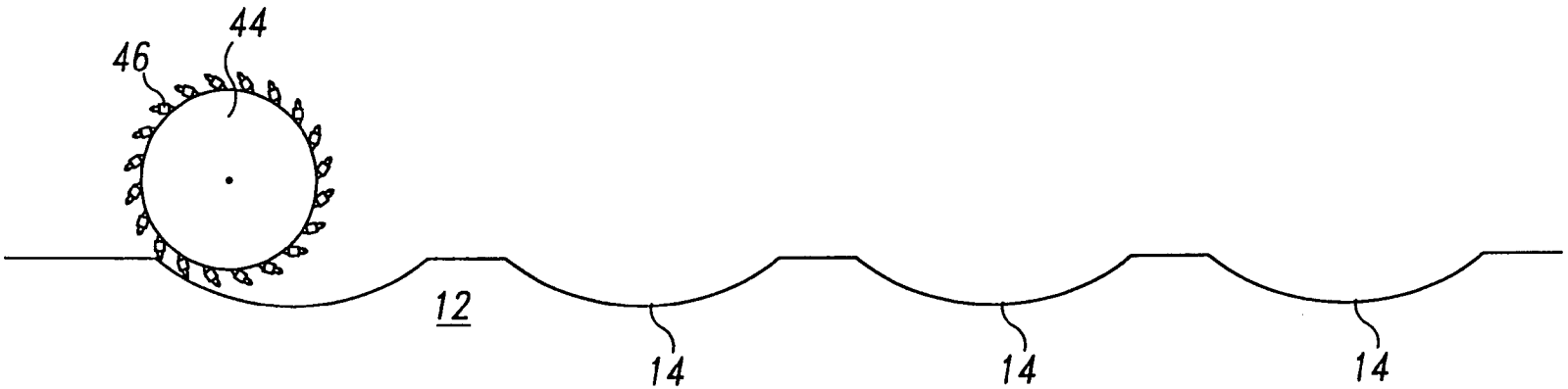
FIGS. 2A and 2B are illustrations of movement patterns of a grinding tool according to certain preferred embodiments of the invention.

As wheel 30 rotates, the grinding drum 44 with cutting tools 46 is continuously lowered to its maximum depth cut and is then raised, forming a tapered depression in the underlying material. Frame or trolley 20 preferably remains level and stable. In one preferred embodiment, shown in FIG. 2A, the drum 44 has a smaller radius than the cut radius. In a less preferred embodiment, the drum is approximately equal to the cut radius.

Figure 2B:
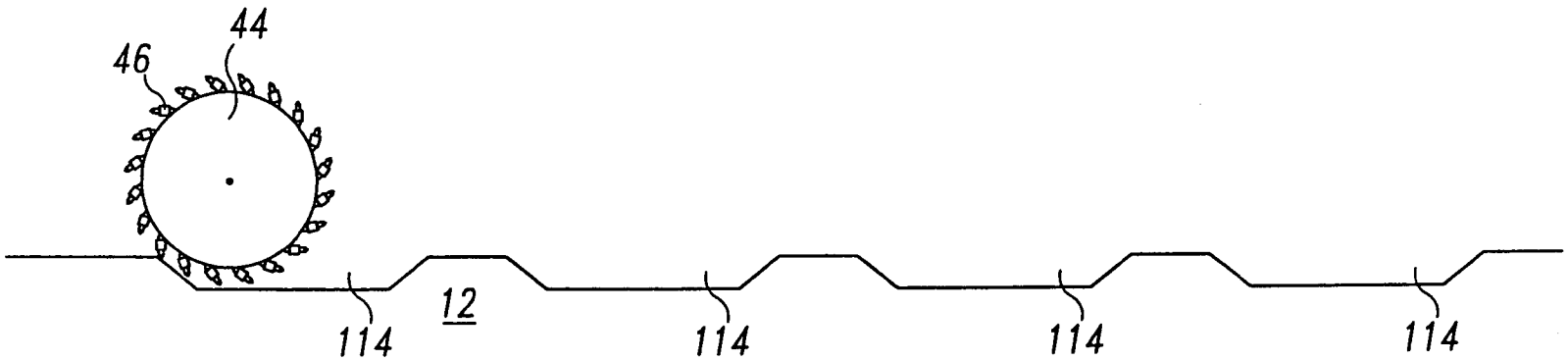

The maximum depth cut amount can be adjusted by adjusting the position of rod 60, for example, at end 64, or the travel distance/flow rate of valve 70. Additionally, various shapes can be milled depending on the machine pattern, such as a semi-circular depression 14 (FIG. 2A) or a flat-bottomed depression 114 (FIG. 2B) with ramp in and ramp out portions, for example for a flat reflector.

Preferably using a continuous or "milled" cut, as the drum is lowered (as opposed to a plunge cut), increases the cutting event time for a given depression, which reduces and moderates the peak power requirements and/or allows more patterns/per minute. For example, a milled cut may be made over approximately ½ a second, while a plunge cut would be done in approximately 1/10 of a second.

Figure 3:
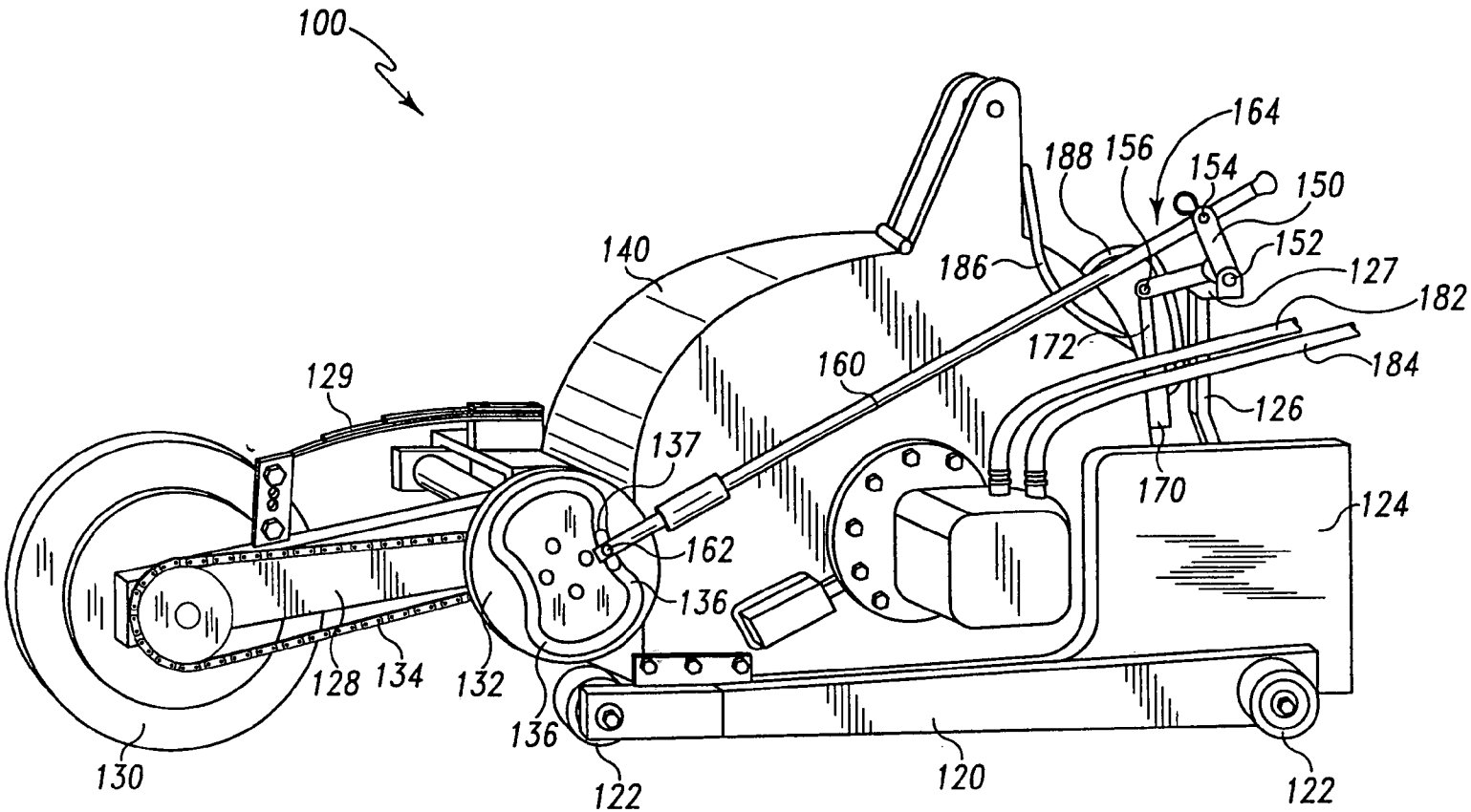
FIG. 3 is an illustration of a second preferred embodiment of the present invention.
Figure 4:
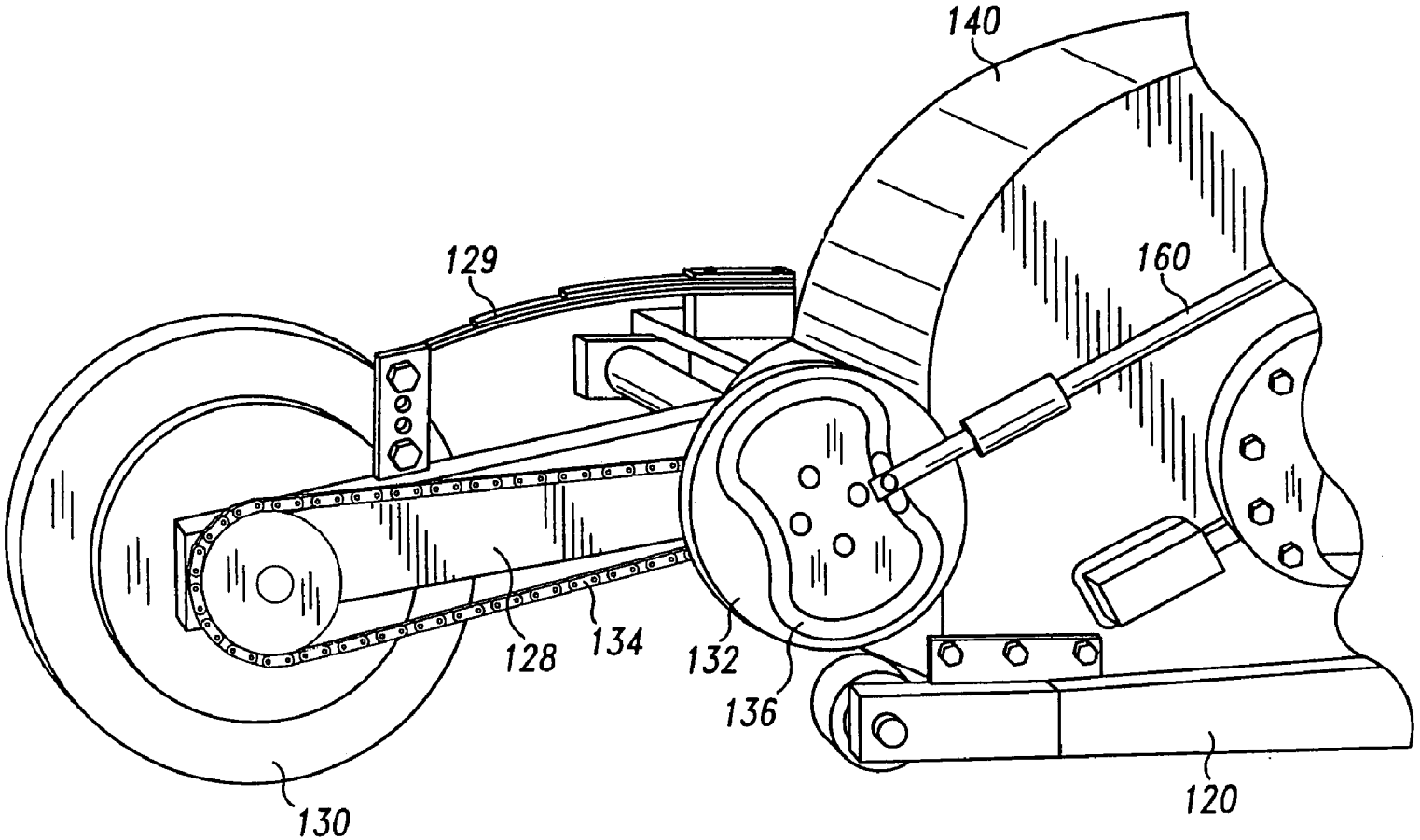
FIGS. 4–7 are detailed partial views of the embodiment of FIG. 3.
Figure 5:
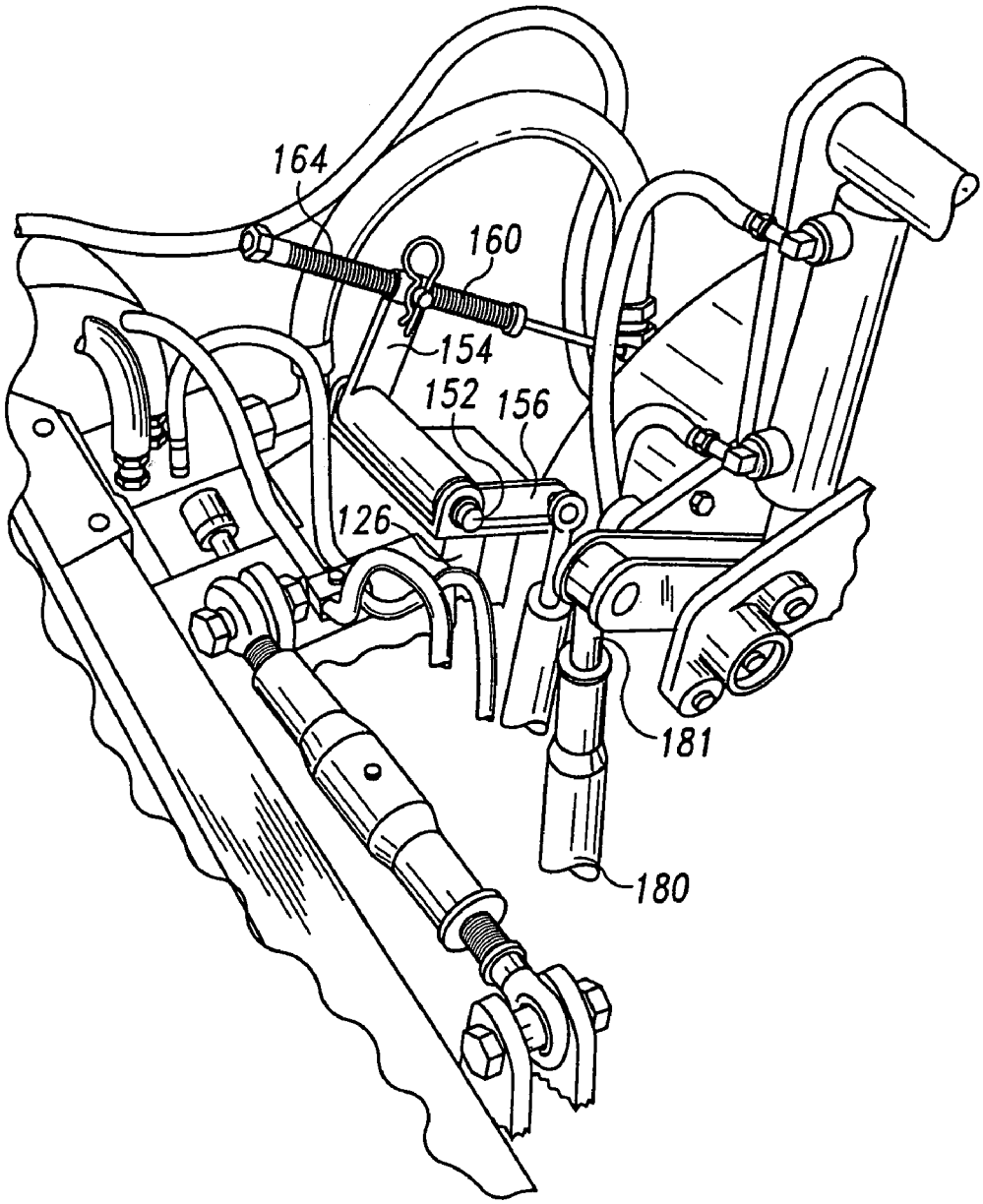
Figure 6:
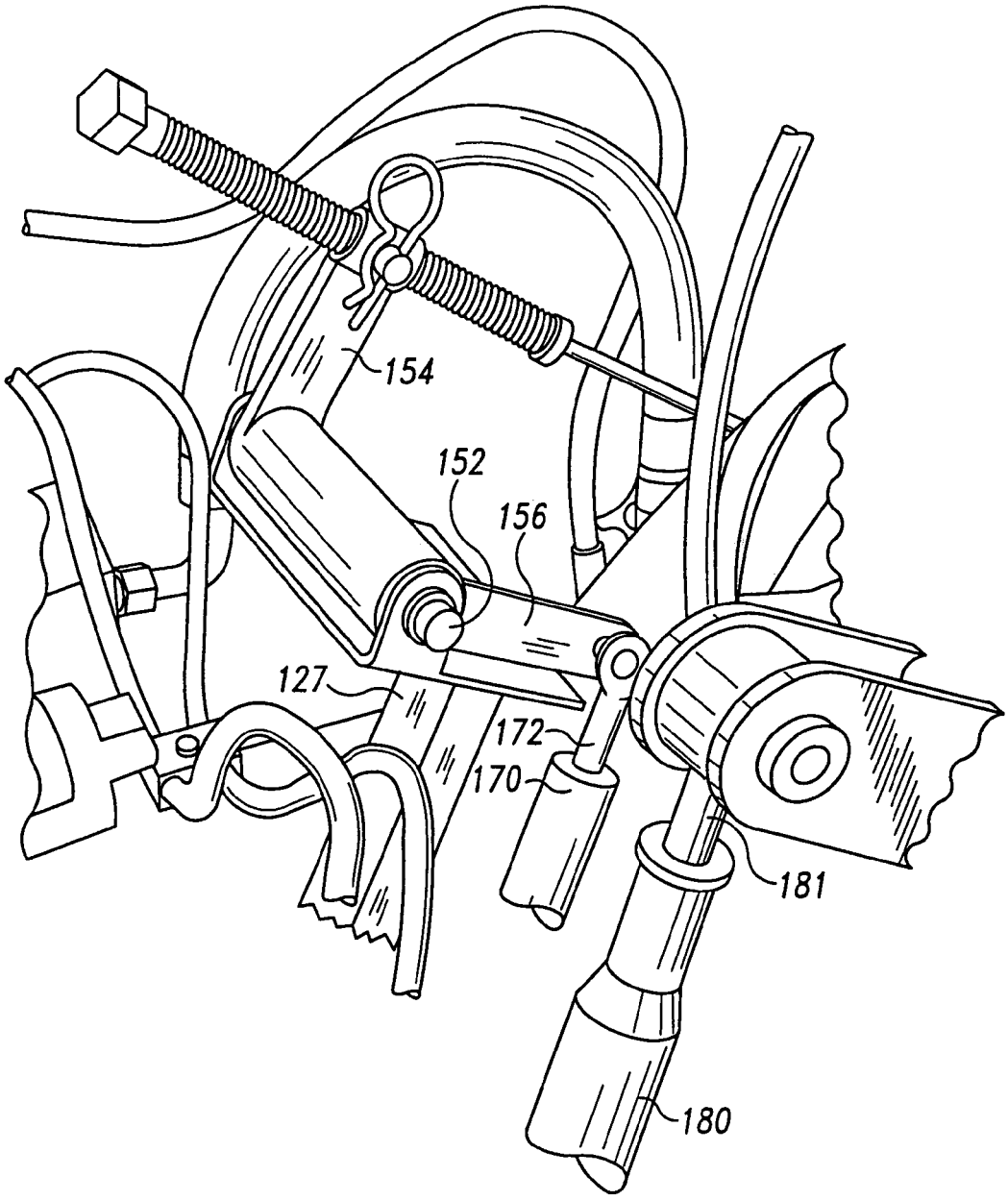
Figure 7:
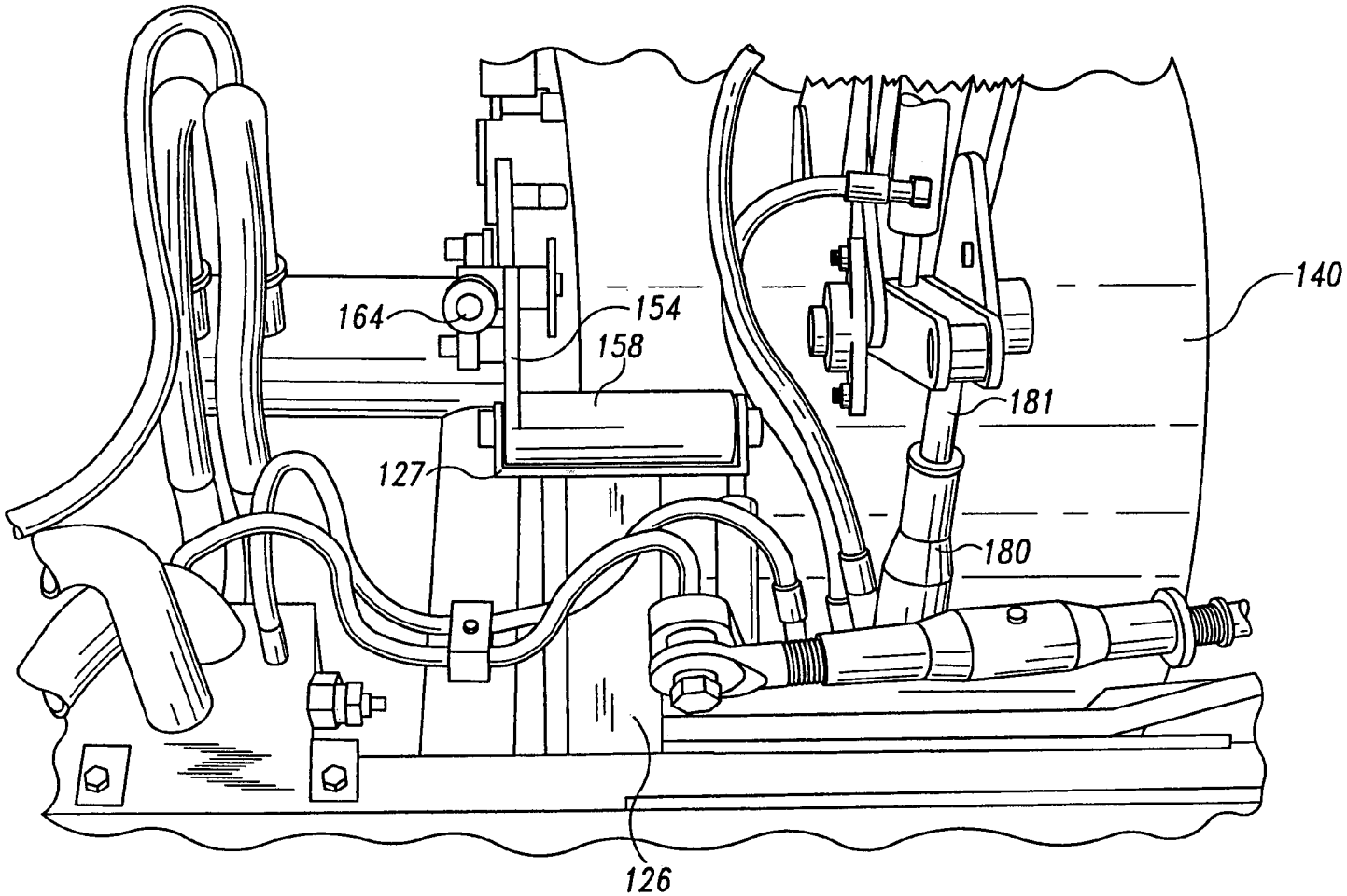

Illustrated in FIGS. 3–7 is an alternate preferred embodiment of the present invention. In FIG. 3, cutting machine 100 includes a ground following element such as trolley 120 supported by wheels 122 such as casters. Trolley 120 typically includes side base members 124 at least one cross bar and a rearwardly mounted upward brace 126. Base portion 125 of upward brace 126 is mounted to trolley 120. Trolley 120 typically moves along the support surface at a uniform or stable height while the grinding assembly is raised and lowered in relation to it.

Preferably, extending forward from trolley 120 is a forward brace 128, upon which is mounted gauge wheel 130. In one embodiment, brace 128 is pivotally mounted to trolley 120 to enable gauge wheel 130 to maintain contact with the ground regardless of the trolley movement. As a preferred feature, gauge wheel 130 and brace 128 are biased, for example with leaf spring 129, to contact the road surface.

Figure 8B:
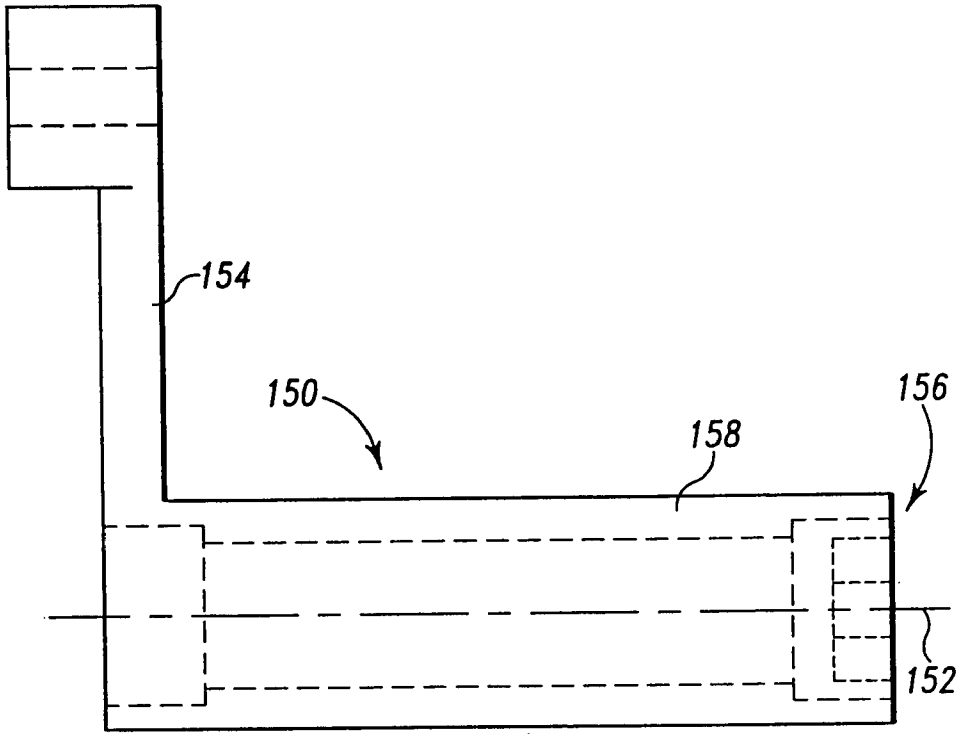
FIGS. 8A & 8B are views of a bell crank used in the embodiment of FIG. 3.
Figure 8A:
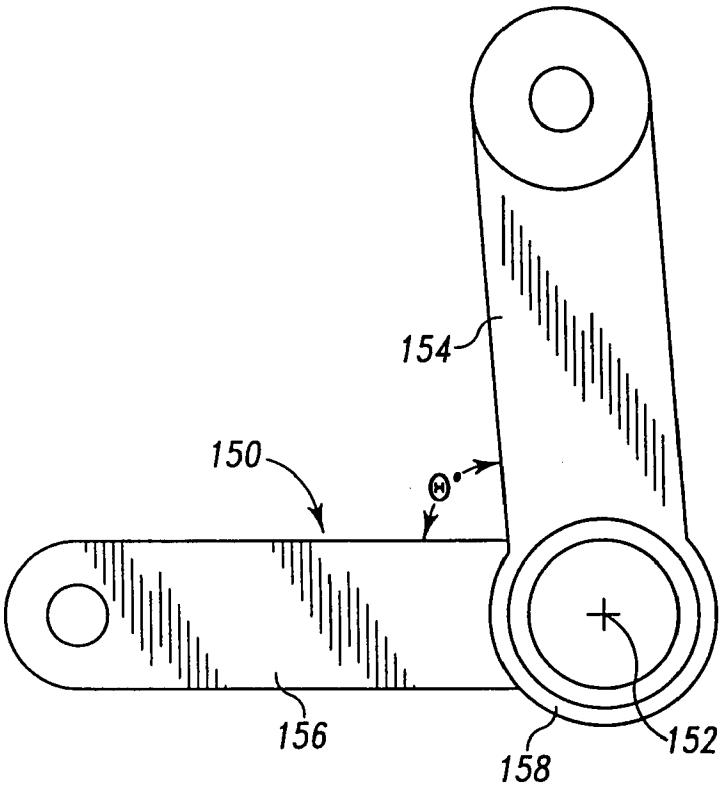
Figure 9C:
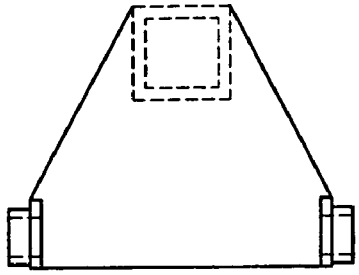
FIGS. 9A–9C are views of an upward brace used in the embodiment of FIG. 3.
Figure 9A:
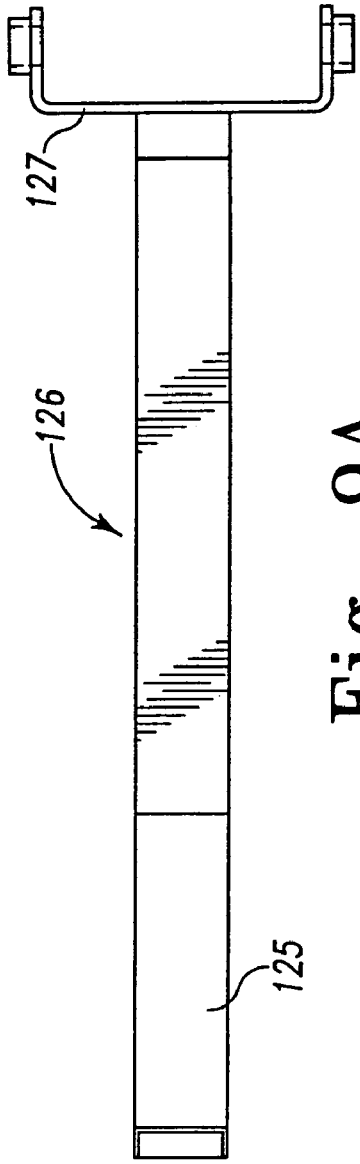
Figure 9B:
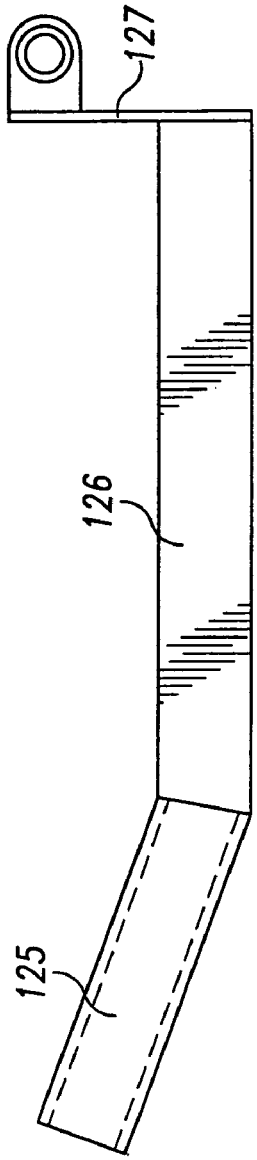

In the embodiment shown, offset from gauge wheel 130 towards the forward end of machine 100 is pattern wheel 132, driven by a sprocket and chain drive 134 from gauge wheel 130. Rod 160 links pattern wheel 132 to a bell crank or corner bracket 150 (FIGS. 8A & 8B) mounted at pivot point 152 adjacent the upper end 127 of brace 126 (FIGS. 9A–9C). Bell crank or bracket 150 includes an axis or pivot point 152, an upper arm 154 and a lower arm 156. The upper arm 154 and lower arm 156 may be in one plane, or may be offset parallel to each other along the pivot axis 152, for example, with cylinder 158. Preferably upper arm 154 and lower arm 156 form a substantial angle θ (FIG. 8A) allowing sufficient leverage when used, for example substantially in the range of ninety degrees. In one preferred embodiment, the arms form an angle θ of 85 degrees.

Preferably, link or rod 160 is pivotally connected at its forward end 162 via a sliding member 137 to a track 136 defined in pattern wheel 132. In the embodiment shown, the track 136 is formed in a "pinched" circle or "figure 8" profile around the rotational axis of pattern wheel 132. Other profiles may be used. The sliding member 137 travels along track 136 as pattern wheel 132 rotates and pushes or pulls rod 160. Alternately rod 160 could be eccentrically pivotally mounted in one position on pattern wheel 132. The opposing end portion 164 of rod 160 is mounted to a point on the upper arm 154 of corner bracket 150. In certain embodiments, the mounting position is adjustable along rod 160.

In this preferred embodiment, a grinding drum and cover assembly 140 is pivotally mounted to the forward end of trolley 120 between side members 124. The drum (not shown) is similar to drum 44 in FIG. 2. Hydraulic cylinder 180 and rod 181 are attached to cover 140 and extend downward to the rear portion of trolley 120. Adjustment valve or cylinder 170 is preferably mounted on and towards the rear of drum and cover assembly 140. Valve rod 172 extends from valve 170 to the lower arm 156 of corner bracket 150. Hydraulic fluid supply and return lines 182 and 184 are connected to the drum assembly, with supply and return lines 186 and 188 connecting hydraulic cylinder 180 to valve 170. Other methods of mounting drum and cover assembly 140 to a frame such as trolley 120, for example an arm or vertical slides, which allow the assembly to be raised and lowered relative to the frame, may also be used.

In operation, grinding machine 100 raises and lowers the grinding drum and cover assembly 140 relative to trolley 120 as machine 100 is moved forward. As gauge wheel 130 rotates, it causes pattern wheel 132 to turn. The forward end 162 of rod 160 is pulled and pushed in correspondence to the movement of the slider 137 in track 136 of wheel 132. Pulling and pushing of rod 160 causes corner bracket 150 to rotate a corresponding amount, which in turn causes valve rod 172 to be pushed or pulled. Pushing or pulling valve rod 172 triggers hydraulic valve 170, which in turn activates hydraulically assisted cylinder 180 and rod 181 to raise or lower the grinding drum and cover assembly 140. The hydraulic assist preferably provides greater power for raising and lowering drum and cover 140 than a mechanical force transmitted by direct linkage from gauge wheel 130. As wheel 130 rotates, the grinding drum is caused to continuously lower to its maximum depth cut and then rise, cutting a tapered or milled depression or series of depressions in the underlying material.

The maximum depth cut amount can be adjusted by adjusting the connection of rod 160 to arm 154 and/or adjusting valve 170. The track defined on pattern wheel 132 can also be used to define the length and depth of the cut. Further, the sprocket ratio between wheel 130 and pattern wheel 132 defines the movement of the grinding drum. For example, the sprocket ratio defines the center-to-center distance of cuts. A 4:1 ratio of wheel sprocket to pattern wheel sprocket would give twice as frequent pattern wheel rotation actuation as a 2:1 ratio per wheel rotation.

Figure 10:
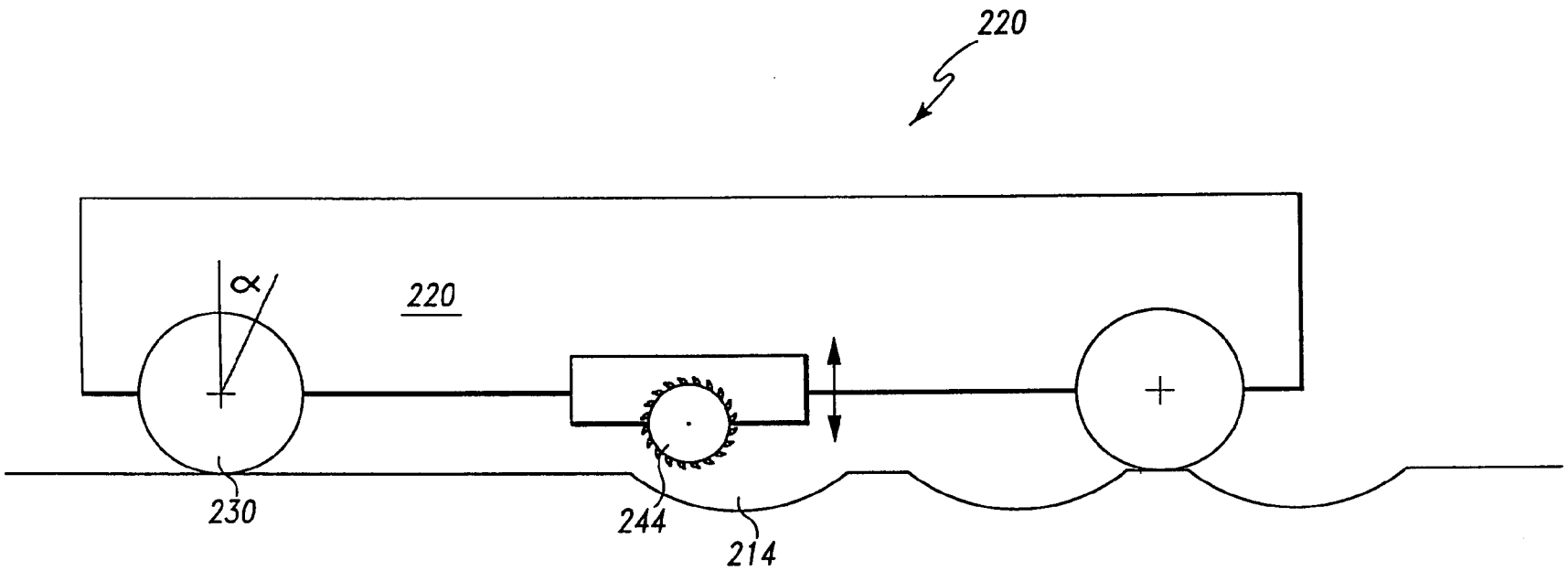
FIG. 10 is an illustration of a third preferred embodiment of the present invention

A further embodiment of a grinding machine 200, is schematically illustrated in FIG. 10. FIG. 10 illustrates a dedicated machine 200 having a surface following element such as a trolley or frame 220 with surface support portions, such as wheels 230. A grinding drum 244 is mounted to frame 220. Grinding drum 244 is preferably hydraulically mounted for vertical movement relative to frame 220 in a predetermined pattern, for example using vertical slides or an arm. An hydraulic control mechanism raises and lowers grinding drum 244 to form depressions 214 as desired. Preferably, the control mechanism is activated by advancement of machine 200. In one embodiment wheel 230 serves as a displacement wheel, such that rotation of wheel 230 through angle a activates the control mechanism. As a dedicated machine, frame 220 may include a conventional hydraulic reservoir and power supply.

The machines can be attachments for host machines, or can alternately be self-contained units which provide their own power. The machines have also been discussed with regard to SNAP or rumble strips, but can also be used to cut other recesses in asphalt, concrete or other materials as well. Examples of other uses in roads include milling reflector recesses and milling recesses for painted stripes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A grinding machine comprising:

a. a surface following frame to be moved along a surface to be ground;

b an hydraulic grinding assembly mounted to said frame;

c. a mechanism causing said grinding assembly to be raised and lowered relative to said frame in a predetermined pattern;

d. a displacement wheel mounted to said frame and mechanically linked to said mechanism; and e. a bell crank pivotally mounted to said frame and an activation rod linking said bell crank and said displacement wheel, wherein said rod is oriented to advance and retract in association with rotation of said displacement wheel, wherein advancement and retraction of said activation rod causes said bell crank to actuate said raising and lowering mechanism.

2. The grinding machine of claim 1 wherein said predetermined pattern is actuated by the advancement of said frame.

3. The grinding machine of claim 2 wherein said grinding assembly is pivotally mounted to said frame.

4. The grinding machine of claim 2 wherein said mechanism for raising and lowering said grinding assembly comprises at least one hydraulic piston.

5. The grinding machine of claim 2, wherein said mechanism for raising and lowering said grinding assembly comprises a pivot arm.

6. The grinding machine of claim 2, wherein said frame comprises ground support elements.

7. The grinding machine of claim 6, wherein said ground support elements are selected from a group consisting of wheels, rollers and skids.

8. The grinding machine of claim 2, wherein said frame is mounted to a host machine.

9. The grinding machine of claim 1, wherein said raising and lowering mechanism is hydraulically assisted.

10. The grinding machine of claim 9, comprising an hydraulic control valve mounted on said grinding assembly.

11. The grinding machine of claim 9, wherein said raising and lowering mechanism comprises at least one hydraulic piston mounted between said frame and said grinding assembly.

12. The grinding machine of claim 11, comprises an hydraulic valve actuated by said displacement wheel to extend and retract said at least one hydraulic piston.

13. The grinding machine of claim 1, wherein said displacement wheel is mounted forward of said frame.

14. The grinding machine of claim 1, wherein said displacement wheel supports said frame over the surface to be ground.

15. The grinding machine of claim 1, wherein said activation rod is eccentrically mounted to said displacement wheel.

16. A grinding machine, comprising:

a. a surface following portion to be moved at a uniform height along a surface to be ground having front and rear ground support elements;

b an hydraulic grinding assembly mounted to said surface following portion;

c. a gauge wheel associated with said surface following portion and in contact with the surface to be ground;

d. a rotating pattern wheel associated with said surface following portion, wherein said pattern wheel is axially offset from and driven by said gauge wheel and;

e. at least one hydraulic piston linked to said pattern wheel to hydraulically raise and lower said grinding assembly relative to said surface following portion and said front and rear ground support elements to grind depressions in the surface in correspondence with the rotation of said gauge wheel.

17. The grinding machine of claim 16, wherein said pattern wheel is driven by a sprocket chain driven by said gauge wheel.

18. The grinding machine of claim 16, comprising a bell crank mounted to said surface following portion, with one bell crank arm linked to said pattern wheel, wherein rotation of said pattern wheel causes said bell crank to rotate, and wherein rotation of said bell crank actuates said raising and lowering mechanism.

19. The grinding machine of claim 18, wherein said one bell crank arm is linked to said pattern wheel via an actuation rod.

20. The grinding machine of claim 19, wherein a second bell crank arm is coupled to an hydraulic valve which operates an hydraulic cylinder to raise and lower said grinding assembly.

21. The grinding machine of claim 20, wherein the arms of said bell crank span an angle of approximately 85 degrees.

22. The grinding machine of claim 18, said bell crank is biased to a position where said grinding assembly is raised, and wherein said pattern wheel is linked to said bell crank to periodically urge said bell crank to a position where said grinding assembly is lowered.

23. The grinding machine of claim 16, wherein said gauge wheel is spring biased to contact the ground.

24. The grinding machine of claim 16, comprising an actuation rod linked to said hydraulic piston, and eccentrically linked to said pattern wheel.

25. The grinding machine of claim 24, wherein said actuation rod is linked to a sliding member in a track defined on said pattern wheel.

* * * * *